US006928844B2

(12) United States Patent
Chiang et al.

(10) Patent No.: US 6,928,844 B2
(45) Date of Patent: Aug. 16, 2005

(54) LATCHING DEVICE FOR A LOCK

(75) Inventors: Wei-Lung Chiang, Chiayi (TW); Sheen-Youl Gao, Yunlin (TW)

(73) Assignee: Tung Lung Metal Industry Co., Ltd., Chiayi (TW)

( * ) Notice: Subject to any disclaimer, the term of this patent is extended or adjusted under 35 U.S.C. 154(b) by 0 days.

(21) Appl. No.: 10/760,613

(22) Filed: Jan. 20, 2004

(65) Prior Publication Data

US 2004/0148982 A1 Aug. 5, 2004

(30) Foreign Application Priority Data

Jan. 20, 2003 (CN) ..... 92201021 U

(51) Int. Cl.[7] ..... E05B 59/00

(52) U.S. Cl. ..... 70/109; 292/1.5; 70/107; 70/134; 70/150

(58) Field of Search ..... 70/109, 106, 107, 70/110, 111, 134, 143–145, 474, 461

(56) References Cited

U.S. PATENT DOCUMENTS

| | | | | | |
|---|---|---|---|---|---|
| 448,912 | A | * | 3/1891 | Deny | 70/134 |
| 451,709 | A | * | 5/1891 | Fey | 70/150 |
| 504,292 | A | * | 8/1893 | Badoni | 70/448 |
| 709,309 | A | * | 9/1902 | Eicher | 70/134 |
| 920,839 | A | * | 5/1909 | DiBella | 70/109 |
| 1,092,414 | A | * | 4/1914 | Wellisch | 70/340 |
| 1,438,140 | A | * | 12/1922 | Rzepka | 70/109 |
| 1,646,674 | A | * | 10/1927 | Angelillo | 70/109 |
| 1,923,443 | A | * | 8/1933 | Knieszer | 70/117 |
| 2,869,351 | A | * | 1/1959 | Rolph | 70/134 |
| 3,266,276 | A | * | 8/1966 | Yulkowski | 70/110 |
| 4,086,794 | A | * | 5/1978 | Richards | 70/134 |
| 4,593,542 | A | * | 6/1986 | Rotondi et al. | 70/134 |
| 4,602,490 | A | * | 7/1986 | Glass et al. | 70/134 |
| 4,656,849 | A | * | 4/1987 | Rotondi et al. | 70/134 |
| 4,902,057 | A | * | 2/1990 | Ching | 292/337 |
| 5,003,796 | A | * | 4/1991 | Tom | 70/107 |
| 5,009,089 | A | * | 4/1991 | Lin | 70/114 |
| 5,201,200 | A | * | 4/1993 | Hauber | 70/107 |
| 5,678,432 | A | * | 10/1997 | Teskey | 70/134 |
| 5,918,916 | A | * | 7/1999 | Kajuch | 292/163 |
| 6,148,650 | A | * | 11/2000 | Kibble | 70/134 |
| 6,196,035 | B1 | * | 3/2001 | Tsui | 70/107 |
| 6,443,503 | B1 | * | 9/2002 | Fan Lu et al. | 292/1.5 |
| 6,526,787 | B2 | * | 3/2003 | Ming-Chih | 70/107 |

* cited by examiner

*Primary Examiner*—Suzanne Dino Barrett
(74) *Attorney, Agent, or Firm*—Senniger Powers

(57) ABSTRACT

A latching device for a lock, comprising a housing, a clutch device, a first latch, a first latch driving member, a second latch, a second latch driving member and a latch spring, so as to provide a function of multiple locking actions.

6 Claims, 7 Drawing Sheets

LATCHING DEVICE FOR A LOCK

BACKGROUND OF THE INVENTION (A) Field of the Invention

The present invention relates to a latching device for a lock, particularly to a latching device for a door lock which is used for building passageways and has an excellent performance against thieves. The present invention has a function of multiple locking actions and is adapted to two different door sizes.

(B) Description of the Relevant Art

The present invention relates to a latching device for a lock, particularly to a latching device for a door lock which is used for building passageways and has an excellent performance against thieves.

When a door is used for a gate, a bedroom, or other private areas, it usually requires a lock with a function of multiple locking actions. Further, standard doors have two different installation distances measured from a keyhole to a door frame: 60 mm and 70 mm. When a door lock is to be used, these two factors have to be considered.

If a door lock is selected according to the dimensions of a building, the desired purposes and the standards thereof, there will be a large number of different door locks required, which increases the amount of stock, as well as the risks of erroneous supply, inappropriate installations, delayed installations, and correcting the installation mistakes. The above facts may result in a considerable increase in costs.

SUMMARY OF THE INVENTION

Accordingly, to overcome the aforementioned limitations, the present invention alternatively provides a latching device for a lock wherein the latching device has a function of multiple locking actions and the installation distance is adjustable.

It is a primary objective of the present invention to provide a latching device for a lock wherein the latching device has a function of multiple locking actions.

It is a further objective of the present invention to provide a latching device for a lock wherein the installation distance is adjustable.

To achieve the above objectives, the latching device for a lock in accordance with the present invention comprises: a housing, a first latch, a first latch driving member, a second latch, and a second latch driving member, wherein the housing is formed with a hollow chamber and two through holes are formed at the front end of the housing; the first latch driving member is received within the housing and includes a front biasing portion, a rear biasing portion, a projection and a through hole; the first latch is provided with a latch head at the front end thereof, and a front biasing portion and a rear biasing portion at the rear end thereof, the rear biasing portion of the first latch being able to be driven rearward by the rear biasing portion of the first latch driving member for retracting the first latch back to its first position within the housing, and the front biasing portion of the first latch being able to be driven forward by the front biasing portion of the first latch driving member for partly extending the first latch out of the housing to its second position; the second latch is provided with a latch head at the front end thereof and at least one biasing portion at the rear end thereof; and the second latch driving member has a hole for inserting a driving member thereinto, a recess for receiving the projection of the first latch driving member to form an aligned arrangement with relative rotation therebetween, and a biasing portion for biasing the second latch rearward to retract the second latch back to its second position within the housing.

The structure and objectives of the present invention can be more readily understood by persons skilled in the art from the following description of the preferred embodiments taken in conjunction with the accompanying drawings.

DETAILED DESCRIPTION OF THE INVENTION

Figure 1:
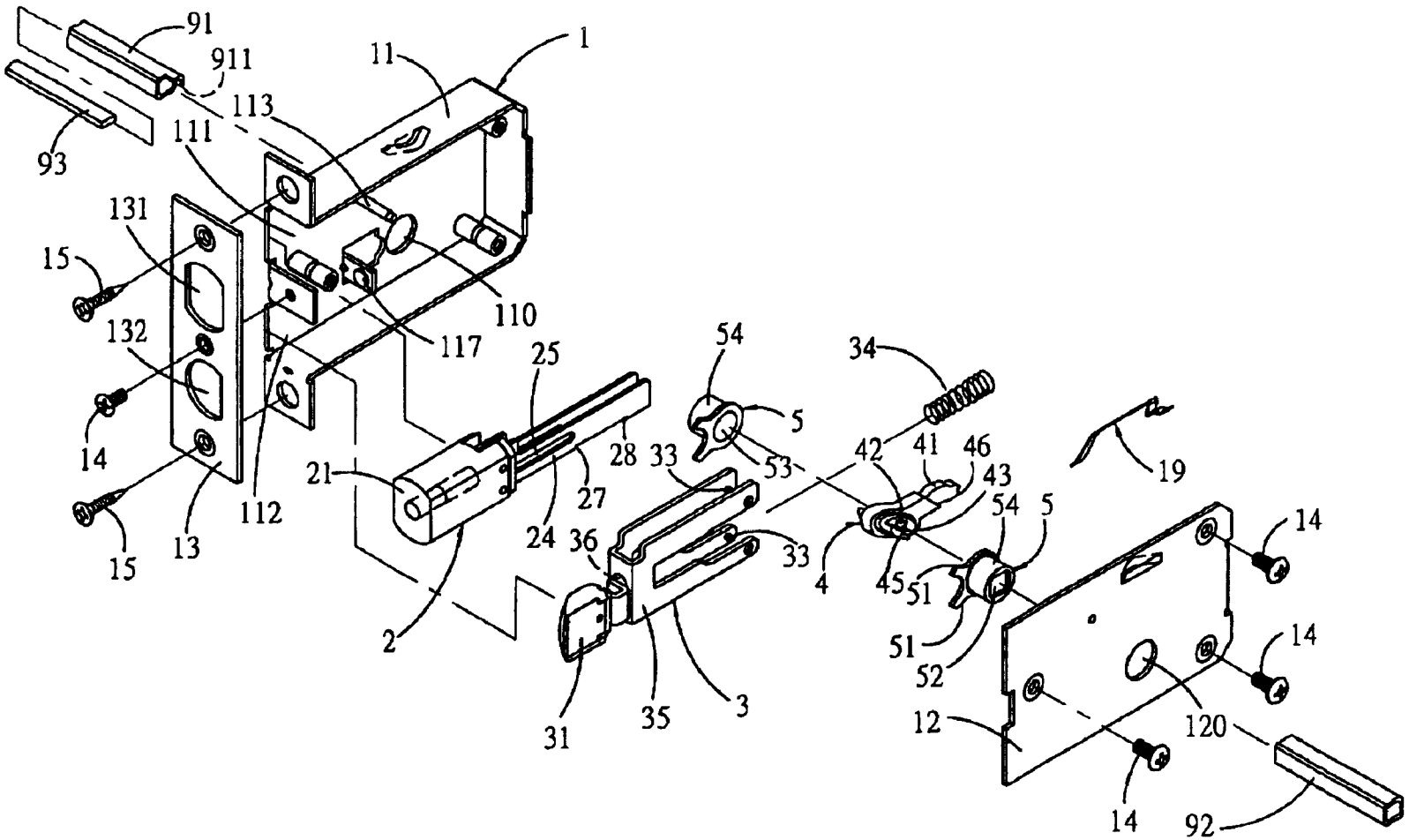
FIG. 1 is an exploded view of a latching device for a lock in accordance with a first embodiment of the present invention.

To realize the objectives, characteristics and advantages of the present invention, the latching device for a lock in accordance with a first embodiment of the present invention can be described, with the accompanying drawings, in further detail as follows:

FIG. 1 is an exploded view of the latching device for a lock in accordance with the first embodiment of the present invention. As shown in FIG. 1, the latching device comprises a housing 1, a first latch 2, a second latch 3, a first latch driving member 4, a spring 19, two second latch driving members 5, as well as a latch spring 34.

The housing 1 is mounted to a door panel (not shown) by screwing screws 15 through the through holes formed thereon, and comprises a main body 11, a cover plate 12 and a face plate 13, which are assembled together by screws 14 to form a hollow chamber for installing the members of the latching device therein, wherein the main body 11 has a post 113, a positioning hole 110, a projection 117, as well as two through holes 111, 112; the cover plate 12 has a positioning hole 120; and the face plate 13 has through holes 131, 132.

The first latch driving member 4 is a cam-shaped plate and is mounted within the housing 1 for selectively driving the first latch 2. The front edge of the cam-shaped plate has a front biasing portion 41 and the rear edge thereof has a rear biasing portion 46. In addition, a projection 43 respectively extends from each lateral side of the plate with a first biasing portion 45 formed thereon. Moreover, a through hole 42 is formed through both projections 43.

The first latch 2 is installed within the housing 1. The front end of the first latch 2 has a latch head 21 with a U-shaped body 24 extending rearwards. The U-shaped body 24 comprises a pair of parallel upright plates and a horizontal plate interconnecting the lower edges of the upright plates. Each upright plate is formed with a slot 25 thereon for receiving the post 113 of the main body 11. The horizontal plate further defines a front biasing portion 27 and a rear biasing portion 28, wherein the rear biasing portion 28 of the first latch 2 can be moved rearward by the rear biasing portion 46 of the first latch driving member 4 to move the latch head 21 of the first latch 2 to its first position where the latch head 21 of the first latch 2 is retracted within the housing 1, and the front biasing portion 27 of the first latch 2 can be moved forward by the front biasing portion 41 of the first latch driving member 4 to move the latch head 21 of the first latch 2 to its second position where the latch head 21 extends out of the housing 1.

The second latch 3 is also installed within the housing 1. The front end of the second latch 3 has a latch head 31 with a U-shaped body 35 extending rearwards. The U-shaped body 35 comprises a top face and four parallel upright plates, wherein four parallel upright plates are arranged in two rows and are perpendicular to the top face. A biasing portion 33 is provided on the rear end of each upright plate and a projection 36 is further formed on the top face of the U-shaped body 35.

Figure 2:
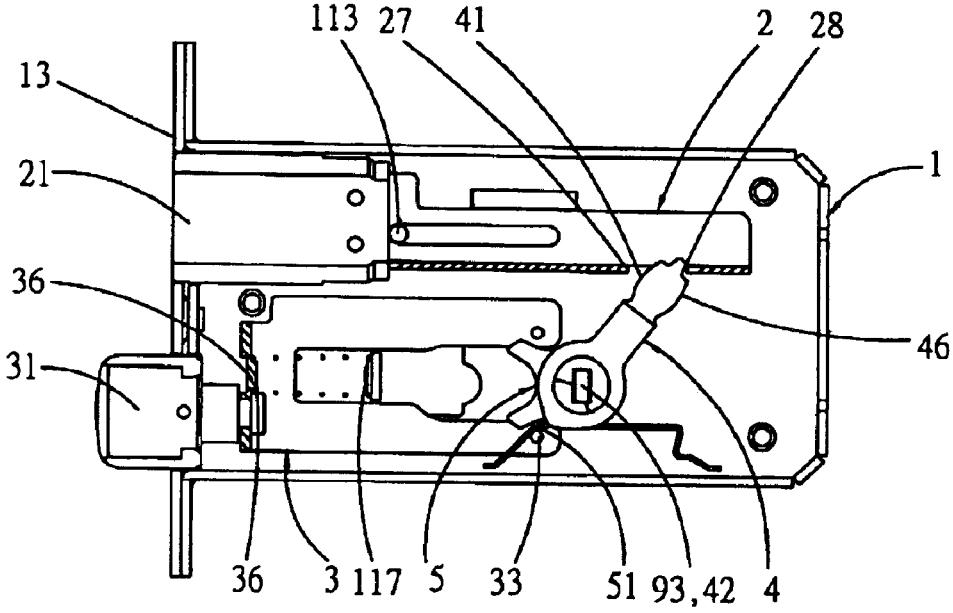
FIG. 2 is a partial sectional view of a latching device for a lock in accordance with the first embodiment of the present invention, wherein the first latch is located at its first position.

The latch spring 34 is also installed within the housing 11 and is supported between the projection 36 of the second latch 3 and the projection 117 of the main body 11 so as to keep the latch head 31 of the second latch 3 at its first position where the latch head 31 extends out of the housing 1 (see FIG. 2).

The spring 19 is received within the housing 1 and is used to support the first latch driving member 4.

Each second latch driving member 5 comprises a cylinder 54 for being inserted into the positioning hole 110 of the main body 11 and the positioning hole 120 of the cover plate 12, respectively. The cylinder 54 has a hole 52 formed at a side for inserting an inside driving member 91 or an outside driving member 92 thereinto which are elongated pipes with a substantially rectangular cross section (see FIG. 5). The other side of the cylinder 54 is provided with two biasing portions 51 and a recess 53 for receiving the projection 43 of the first latch driving member 4 to form an aligned arrangement with relative rotation therebetween such that when the biasing portions 51 of the second latch driving member 5 are rotated clockwise or counterclockwise to press against either one of the biasing portions 33 of the second latch 3, the latch spring 34 is compressed and the latch head 31 of the second latch 3 is retracted back to its second position within the housing 1 (see FIG. 4).

As shown in FIGS. 2, 3, 5 and 6, a crank 93 is inserted through the through hole 42 of the first latch driving member 4. To operate the latching device to perform the desired locking function, the crank 93 is rotated by either a key (not shown) from the outside of the door (not shown) or a doorknob (not shown) from the inside of the door to press the front biasing portion 41 of the first biasing member 4 against the front biasing portion 27 of the first latch 2 and the latch head 21 of the first latch 2 is then extended out of the housing 1 (see FIG. 3).

As shown in FIGS. 2, 3, 4, 5 and 6, to operate the latching device to perform the desired unlocking function, the crank 93 is rotated by either a key (not shown) from the outside of the door or a doorknob (not shown) from the inside of the door to press the rear biasing portion 46 of the first biasing member 4 against the rear biasing portion 28 of the first latch 2 and the latch head 21 of the first latch 2 is then retracted back into the housing 1 (see FIG. 2). A handle (not shown) mounted to either the inside or the outside of the door is further rotated such that the inside driving member 91 or the outside driving member 92, which connects with the handle, directly drives the second latch driving member 5 for pressing the biasing portion 51 of the second latch driving member 5 against the biasing portion 33 of the second latch 3 and the latch head 31 of the second latch 3 is retracted back into the housing 1 (see FIG. 4) for opening the door.

Figure 3:
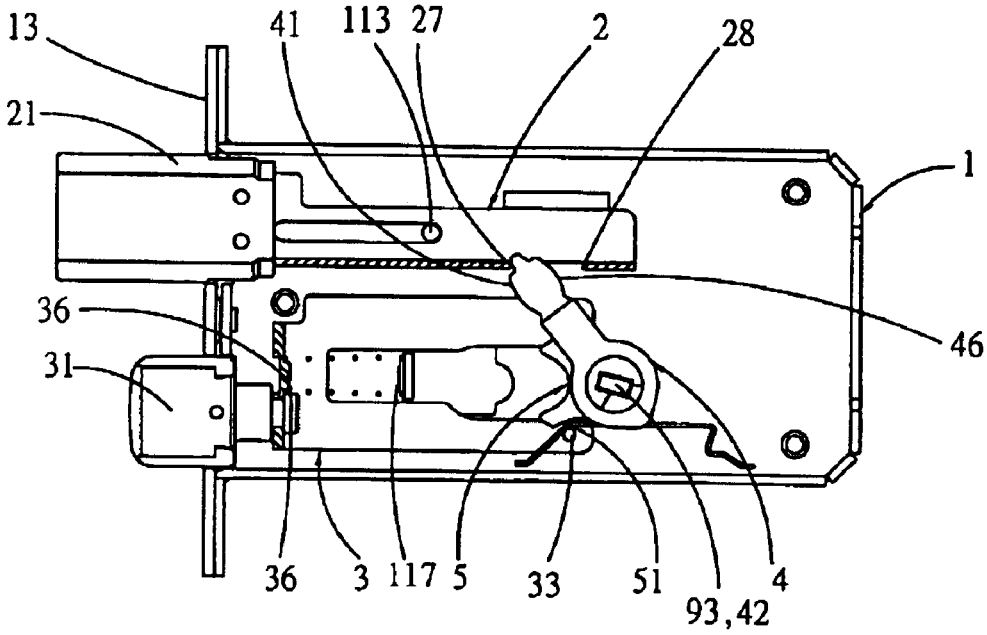
FIG. 3 is a partial sectional view of a latching device for a lock in accordance with the first embodiment of the present invention, wherein the first latch is located at its second position.
Figure 4:
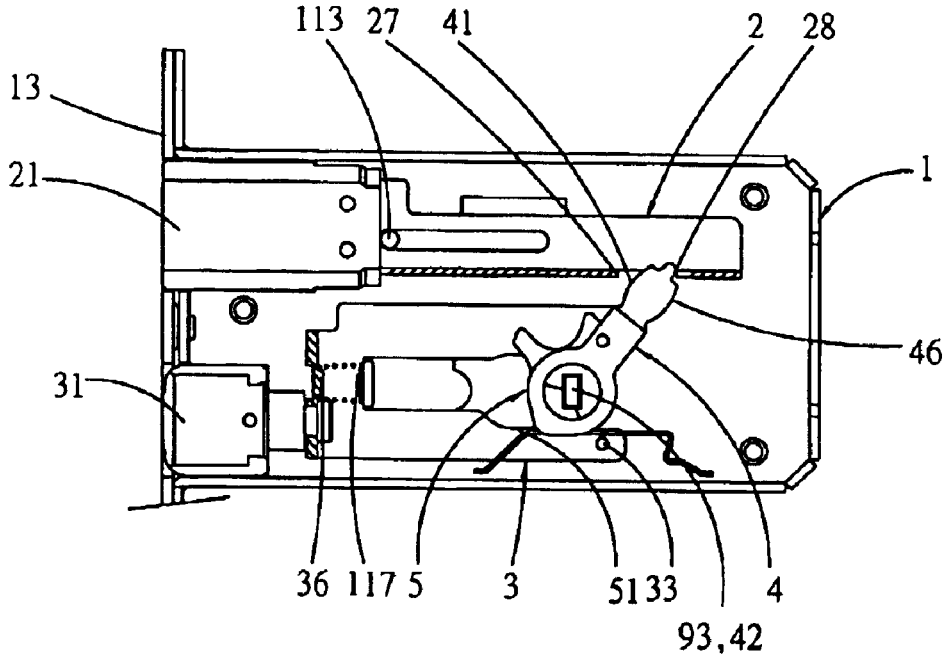
FIG. 4 is a partial sectional view of a latching device for a lock in accordance with the first embodiment of the present invention, wherein the second latch is located at its second position.
Figure 5:
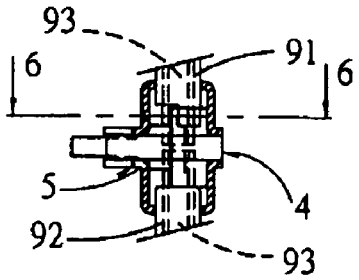
FIG. 5 is a partial sectional view showing the combination of the first latch driving member, the second latch driving member, driving members and a crank of a latching device for a lock in accordance with the first embodiment of the present invention.
Figure 6:
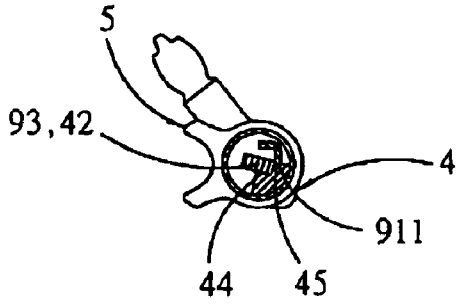
FIG. 6 is a sectional view taken along Line 6—6 in FIG. 5.

Alternatively, as shown in FIGS. 2, 3 and 4, only the handle mounted to the inside of the door is rotated to drive the inside driving member 91. The inside driving member 91 has a driving portion 911 extending therefrom. By rotating the handle, the driving portion 911 of the inside driving member 91 drives the first biasing portion 45 formed at a side of the first latch driving member 4 to in turn press the rear biasing portion 46 of the first latch driving member 4 against the rear biasing portion 28 of the first latch 2 and the latch head 21 of the first latch 2 is then retracted back into the housing 1 (see FIG. 2) so as to place the latching device at an unlocked state. In addition, since the inside driving member 91 has a rectangular cross section and engages with the hole 52 of the second latch driving member 5, the biasing portion 51 of the second latch driving member 5 is driven by the inside driving member 91 simultaneously to push the biasing portion 33 of the second latch 3, such that the latch head 31 of the second latch 3 is retracted back to the housing 1 for opening the door (see FIG. 4).

The above latching device in accordance with the first embodiment of the present invention can be modified to the one which is adjustable for being adapted to different installation distances.

Figure 7:
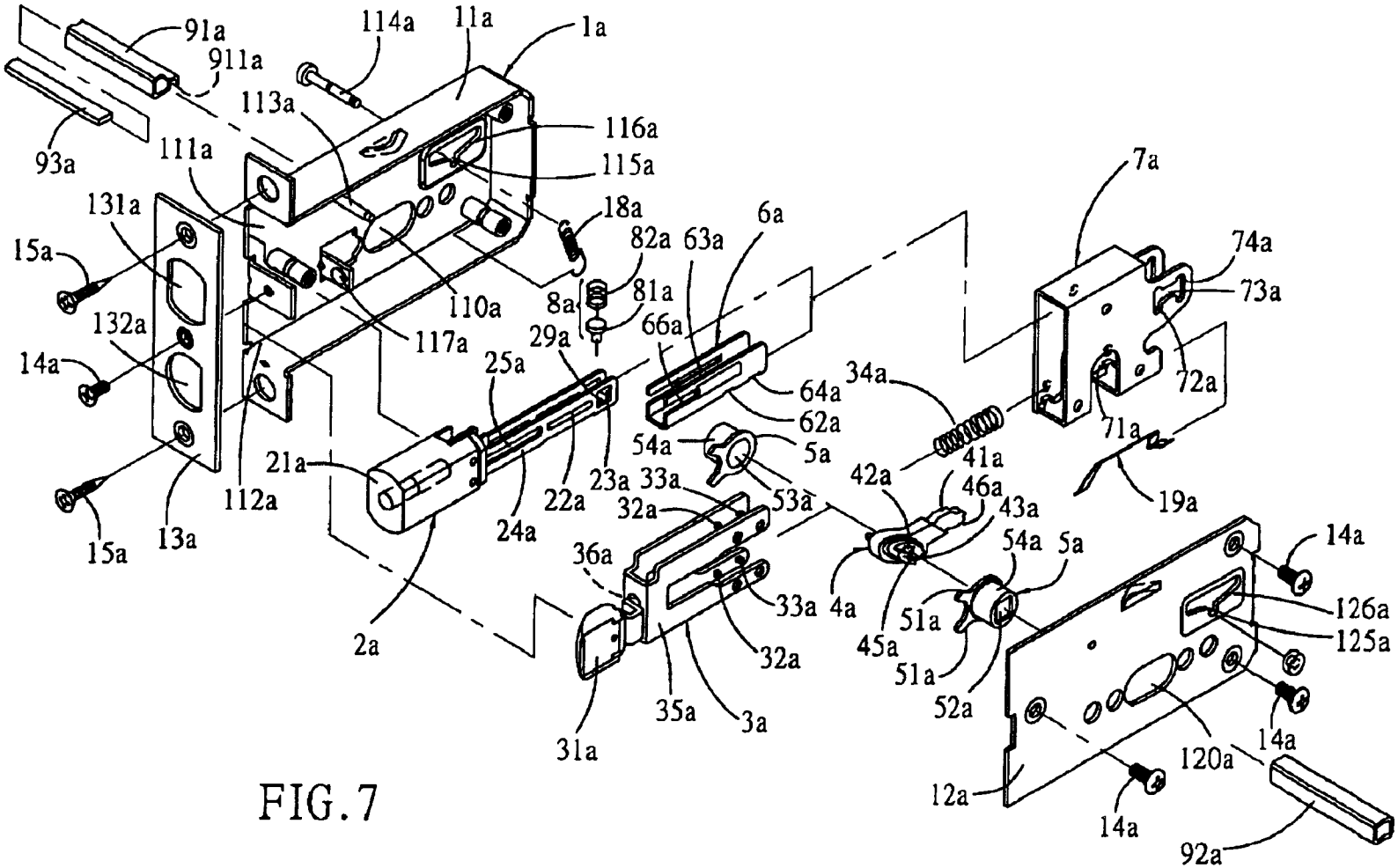
FIG. 7 is an exploded view of a latching device for a lock in accordance with a second embodiment of the present invention.

FIG. 7 shows an exploded view of a latching device for a lock in accordance with the second embodiment of the present invention. As shown, the latching device comprises a housing 1*a*, a first latch 2*a*, an extension member 6*a*, a first latch driving member 4*a*, a second latch 3*a*, a latch spring 34*a*, a spring 19*a*, two second latch driving members 5*a*, a clutch device 8*a*, an adjusting member 7*a*, as well as a pin 114*a*.

The housing 1*a* is mounted to a door panel (not shown) by screwing screws 15*a* through the through holes formed thereon, and comprises a main body 11*a*, a cover plate 12*a* and a face plate 13*a*, which are assembled together by screws 14*a* to form a hollow chamber for installing the members of the latching device therein, wherein the main body 11 a has a post 113*a*, a positioning hole 110*a*, a projection 117*a*, two through holes 111*a*, 112*a*, as well as a T-shaped slot including a vertical slot 115*a* and a horizontal slot 116*a*; the cover plate 12*a* has a positioning hole 120*a* and a T-shaped slot including a vertical slot 125*a* and a horizontal slot 126*a*; and the face plate 13*a* has through holes 131*a*, 132*a*.

The first latch driving member 4*a* is a cam-shaped plate and is mounted within the housing 1 a for selectively driving the first latch 2*a*. The front edge of the cam-shaped plate has a front biasing portion 41*a* and the rear edge thereof has a rear biasing portion 46*a*. In addition, a projection 43*a* respectively extends from each lateral side of the plate with a first biasing portion 45*a* formed thereon. Moreover, a through hole 42*a* is formed through both projections 43*a*.

The first latch 2*a* is installed within the housing 1*a*. The front end of the first latch 2*a* has a latch head 21*a* with a U-shaped body 24*a* extending rearwards. The U-shaped body 24*a* comprises a pair of parallel upright plates and a horizontal plate interconnecting the lower edges of the upright plates. On each upright plate is formed with a first slot 25*a* for receiving the post 113*a* of the main body 11*a*, as well as a second slot 22*a* and a through hole 23*a*. The horizontal plate further defines a positioning hole 29*a* which, together with the through holes 23*a* of the upright plates, receives a positioning member 81*a* and a positioning spring 82*a* of the clutch device 8*a* (see FIG. 8).

The extension member 6*a* engages with the rear end of the first latch 2*a* and is also a U-shaped body comprising a pair of parallel upright plates and a horizontal plate interconnecting the lower edges of the upright plates. On each upright plate is formed with a slot 66*a* and a sliding portion 63*a* for slidably mating with the respective second slot 22*a* of the first latch 2*a*. The horizontal plate further defines a front biasing portion 65*a*, a rear biasing portion 67*a*, a front positioning portion 62*a* a rear positioning portion 64*a*, a front projection 68*a* and a rear projection 69*a* (see FIG. 9) wherein the front positioning portion 62*a* and the rear positioning portion 64*a* selectively engage with the positioning member 81*a* of the clutch device 8*a*; the rear biasing portion 67*a* is biased rearward by the rear biasing portion 46*a* of the first latch driving member 4*a* to retract the latch head 21*a* of the first latch 2*a* back to its first position within the housing 1*a* (see FIG. 8 or FIG. 9); and the front biasing portion 65*a* is biased forward by the front biasing portion 41*a* of the first latch driving member 4*a* to move the latch head 21*a* of the first latch 2*a* to its second position where the latch head 21*a* extends out of the housing 1*a* (see FIG. 10 or FIG. 11).

The second latch 3*a* is also installed within the housing 1*a*. The front end of the second latch 3*a* has a latch head 31*a* with a U-shaped body 35*a* extending rearwards. The U-shaped body 35*a* comprises a top face and four parallel upright plates, wherein four parallel upright plates are arranged in two rows and are perpendicular to the top face. A front biasing portion 32*a* and a rear biasing portion 33*a* are provided on the rear end of each upright plate and a projection 36*a* is further formed on the top face of the U-shaped body 35*a*.

The spring 19*a* is received within the housing 1*a* and is used to support the first latch driving member 4*a*.

Each second latch driving member 5*a* comprises a cylinder 54*a* for being inserted into the positioning hole 110*a* of the main body 11*a* and the positioning hole 120*a* of the cover plate 12*a*, respectively. The cylinder 54*a* has a hole 52*a* formed at a side for inserting an inside driving member 91*a* or an outside driving member 92*a* thereinto which are elongated pipes with a substantially rectangular cross section (see FIG. 12). The other side of the cylinder 54*a* is provided with two biasing portions 51*a* and a recess 53*a* for receiving the projection 43*a* of the first latch driving member 4*a* to form an aligned arrangement with relative rotation therebetween and be controlled by the inner driving member 91*a*, the outer driving member 92*a* and cranks 93*a* (see FIG. 12).

Figure 8:
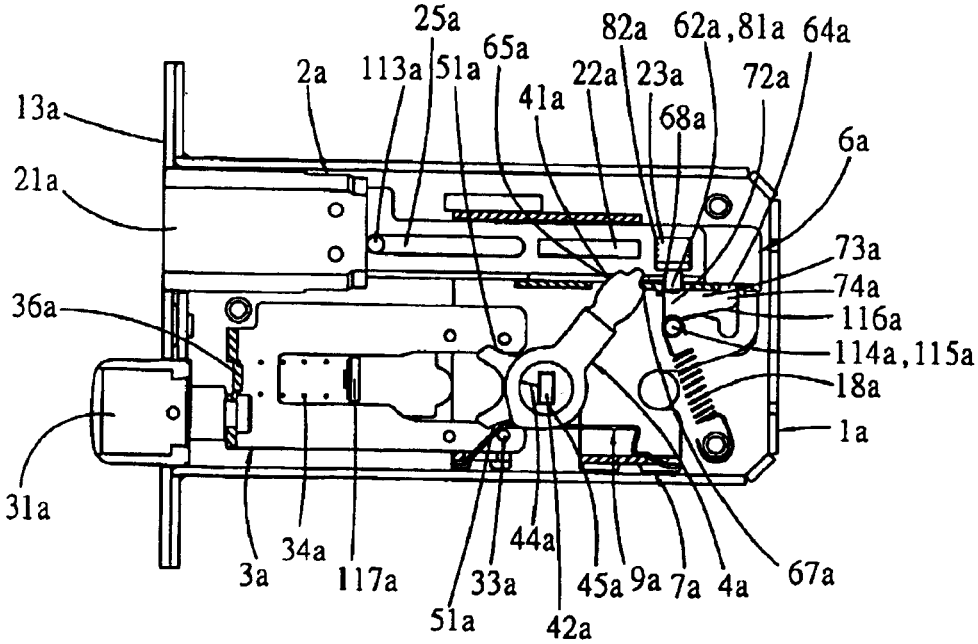
FIG. 8 is a partial sectional view of a latching device for a lock in accordance with the second embodiment of the present invention, wherein the adjusting member is adapted to a 70 mm installation distance, and the first latch is located at its first position.
Figure 10:
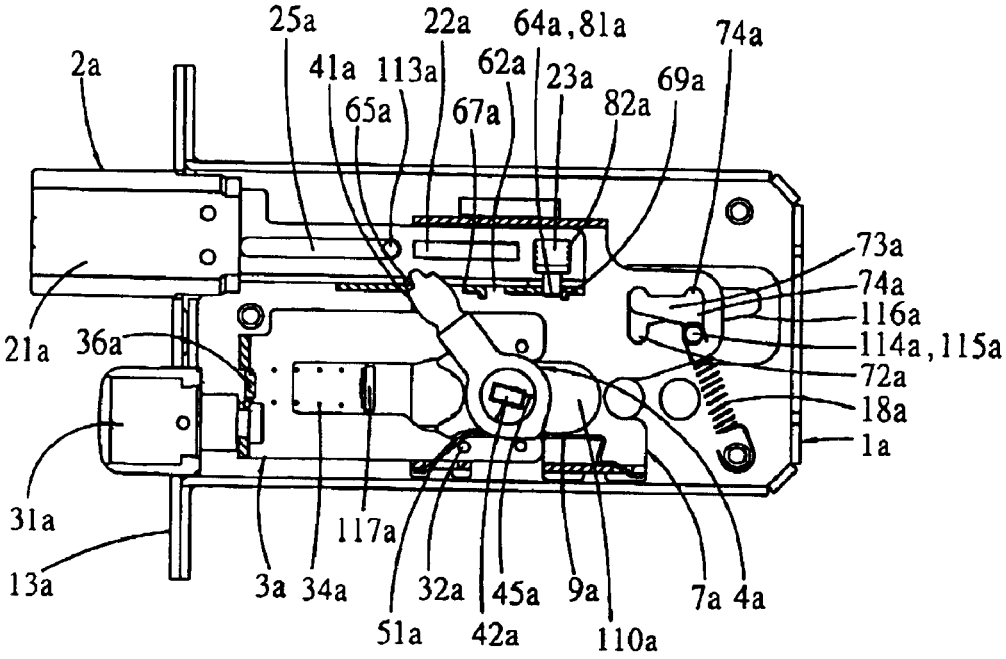
FIG. 10 is a partial sectional view of a latching device for a lock in accordance with the second embodiment of the present invention, wherein the adjusting member is adapted to a 60 mm installation distance, and the first latch is located at its second position.
Figure 11:
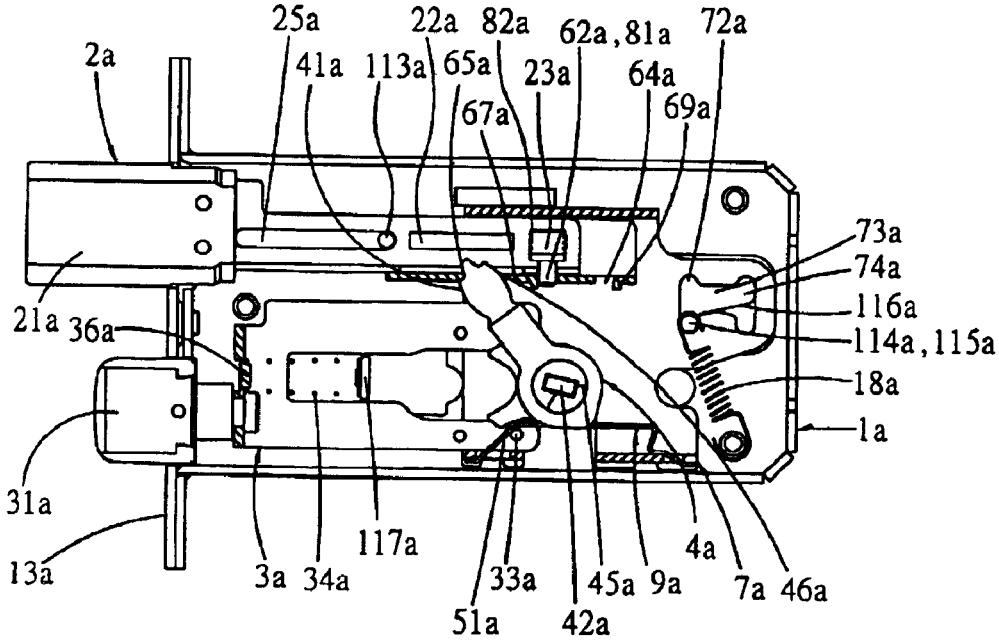
FIG. 11 is a partial sectional view of a latching device for a lock in accordance with the second embodiment of the present invention, wherein the adjusting member is adapted to a 70 mm installation distance, and the first latch is located at its second position.
Figure 14:
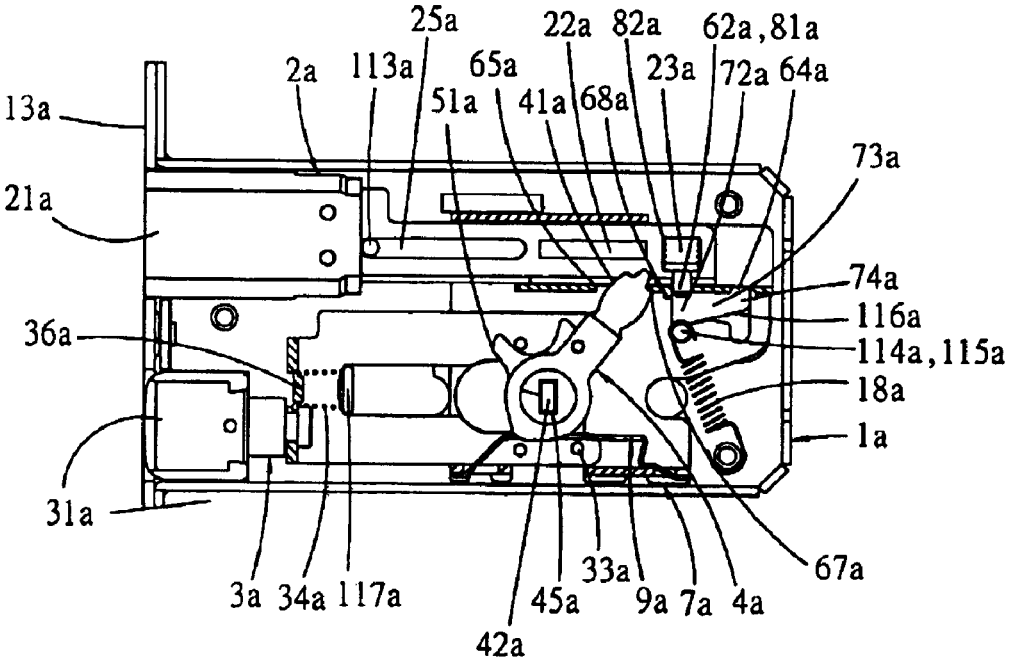
FIG. 14 is a partial sectional view of a latching device for a lock in accordance with the second embodiment of the present invention, wherein the second latch is located at its second position.

Moreover, the second latch 3*a* is supported by the latch spring 34*a* located between the projection 36*a* of the second latch 3*a* and the projection 117*a* of the main body 11*a*, such that the latch head 31*a* of the second latch 3*a* is at its first position where the latch head 31*a* extends out of the housing 1*a* (see FIG. 8 and FIG. 10). Accordingly, when the biasing portions 51*a* of the second latch driving member 5*a* are rotated clockwise or counterclockwise to press against the front biasing portion 32*a* or the rear biasing portion 33*a* of the second latch 3*a*, the latch spring 34*a* is compressed and the latch head 31*a* of the second latch 3*a* is retracted back to its second position within the housing 1*a* (see FIG. 14).

The adjusting member 7*a* is in the shape of a substantially hollow parallelepiped body and is received within the housing 1*a*. Each side wall of the adjusting member 7*a* is formed with a driving portion 71*a* and a H-shaped slot which includes a front vertical slot 72*a*, a horizontal slot 73*a* and a rear vertical slot 74*a*.

The pin 114*a* passes through the T-shaped slot of the main body 11*a*, the H-shaped slots of the adjusting member 7*a* and the T-shaped slot of the cover plate 12*a*, and is used to operate the positioning member 81*a* of the clutch device 8*a* and push the extension member 6*a* for selectively engaging the positioning member 81*a* of the clutch device 8*a* with the front positioning portion 62*a* or the rear positioning portion 64*a*. In addition, the driving portions 71*a* of the adjusting member 7*a* push the first latch driving member 4*a* and the second latch driving member 5*a* to slidably move them within a range defined by the positioning hole 110*a* of the main body 11*a* and the positioning hole 120*a* of the cover plate 12*a* for the first latch driving member 4*a* to operate the first latch 2*a* and the second latch driving member 5*a* to operate the second latch 3*a*.

Figure 9:
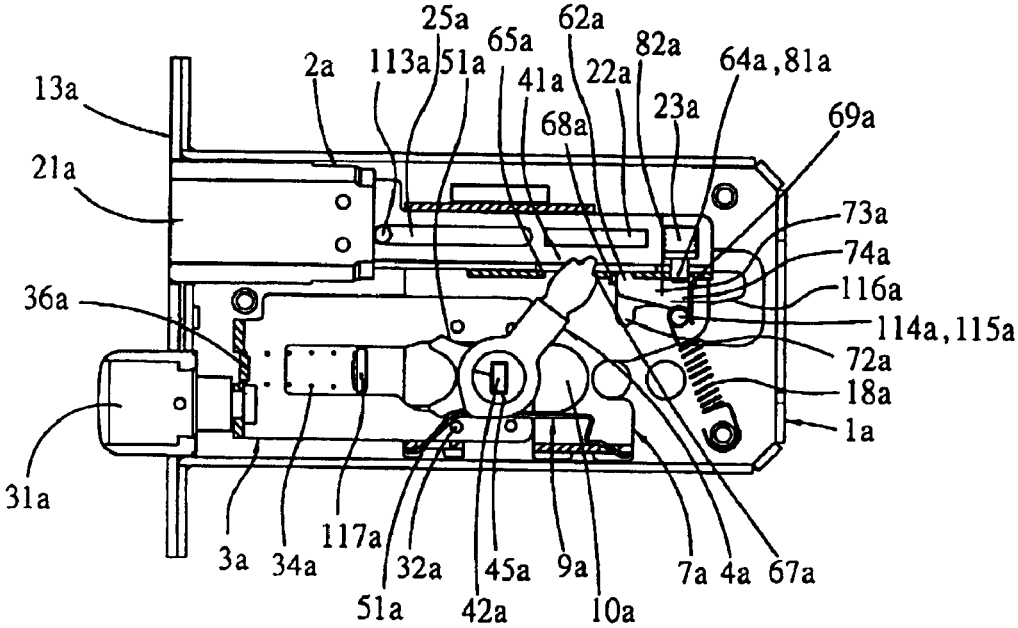
FIG. 9 is a partial sectional view of a latching device for a lock in accordance with the second embodiment of the present invention, wherein the adjusting member is adapted to a 60 mm installation distance, and the first latch is located at its first position.

As shown in FIGS. 8 and 9, to adjust the installation distance of the latching device from 70 mm (see FIG. 8) to 60 mm (see FIG. 9), the pin 114*a* is moved upward to move the positioning member 81*a* upward and disengage the positioning member 81*a* from the front positioning hole 62*a* of the extension member 6*a*, while the pin 114*a* is partly located at the front positioning portion 62*a*. The pin 114*a* is then moved horizontally forward to drive the front projection 68*a* of the extension member 6*a* such that the extension member 6*a* is moved forward to a desired position to align the rear positioning portion 64*a* of the extension member 6*a* with the positioning member 81*a*, whereby the positioning member 81*a* is moved downward under the force of the positioning spring 82*a* so as to engage it with the rear positioning portion 64*a* (see FIG. 9).

Moreover, when the pin 114*a* is moved horizontally forward, the driving portions 71*a* of the adjusting member 7*a* drive the cylinders 54*a* of the second latch driving members 5*a* to further drive the first latch driving member 4*a* which is held between two second latch driving members 5, to move forward and the second latch driving members 5 are operative to the front biasing portions 32*a*. At this moment, under the force of a spring 18*a*, the pin 114*a* moves along the horizontal slot 116*a* of the main body 11*a* and the corresponding horizontal slot 126*a* of the cover plate 12*a*, to the vertical slot 115*a* of the main body 11*a* and the corresponding vertical slot 125*a* of the cover plate 12*a*.

As shown in FIGS. 8 and 9, to adjust the installation distance of the latching device from 60 mm (see FIG. 9) to 70 mm (see FIG. 8), the pin 114*a* is moved upward to move the positioning member 81*a* upward and disengage the positioning member 81*a* from the rear positioning hole 64*a* of the extension member 6*a*, while the pin 114*a* is partly located at the rear positioning portion 64*a*. The pin 114*a* is then moved horizontally rearward to drive the rear projection 69*a* of the extension member 6*a* such that the extension member 6*a* is moved rearward to a desired position to align the front positioning portion 62*a* of the extension member 6*a* with the positioning member 81*a*, whereby the positioning member 81*a* is moved downward under the force of the positioning spring 82*a* so as to engage it with the front positioning portion 62*a* (see FIG. 8).

Moreover, when the pin 114*a* is moved horizontally rearward, the lo driving portions 71*a* of the adjusting member 7*a* drive the cylinders 54*a* of the second latch driving members 5*a* to further drive the first latch driving member 4*a* which is held between two second latch driving members 5, to move rearward and the second latch driving members 5 are operative to the rear biasing portions 33*a*. At this moment, under the force of a spring 18*a*, the pin 114*a* moves along the horizontal slot 116*a* of the main body 11*a* and the corresponding horizontal slot 126*a* of the cover plate 12*a*, to the vertical slot 115*a* of the main body 11*a* and the corresponding vertical slot 125*a* of the cover plate 12*a*.

Figure 12:
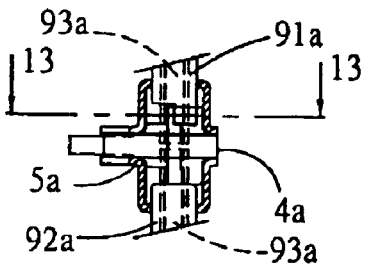
FIG. 12 is a partial sectional view showing the combination of the first latch driving member, the second latch driving member, driving members and a crank of a latching device for a lock in accordance with the second embodiment of the present invention.
Figure 13:
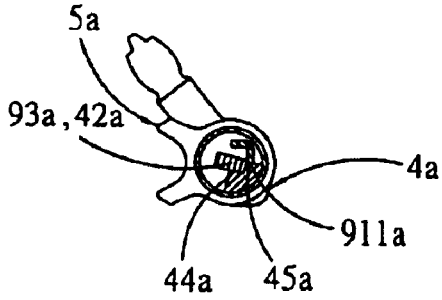
FIG. 13 is a sectional view taken along Line 13—13 in FIG. 12.

As shown in FIGS. 9, 12 and 13, the crank 93*a* is inserted through the through hole 42*a* of the first latch driving member 4*a*. To operate the latching device with a 60 mm installation distance to perform the desired locking function, the crank 93*a* is rotated by either a key (not shown) from the outside of the door (not shown) or a doorknob (not shown) from the inside of the door to press the front biasing portion 41*a* of the first biasing member 4*a* against the front biasing portion 65*a* of the extension member 6*a* to further drive the first latch 2*a*, and the latch head 21*a* of the first latch 2*a* is then extended out of the housing 1*a* (see FIG. 10).

As shown in FIGS. 10, 12 and 13, to operate the latching device with a 60 mm installation distance to perform the desired unlocking function, the crank 93*a* is rotated by either a key (not shown) from the outside of the door or a doorknob (not shown) from the inside of the door to press the rear biasing portion 46*a* of the first biasing member 4*a* against the rear biasing portion 67*a* of the extension member 6*a* to further drive the first latch 2*a* and the latch head 21*a* of the first latch 2*a* is then retracted back into the housing 1*a* (see FIG. 9). A handle (not shown) mounted to either the inside or outside of the door is further rotated such that the inside driving member 91*a* or the outside driving member 92*a*, which connects with the handle, directly drives the second latch driving member 5*a* for pressing the biasing portion 51*a* of the second latch driving member 5*a* against the front biasing portion 32*a* of the second latch 3*a* and the latch head 31*a* of the second latch 3*a* is retracted back into the housing 1*a* for opening the door.

Alternatively, as shown in FIGS. 12 and 13, only the handle mounted to the inside of the door is rotated to drive the inside driving member 91*a*. The inside driving member 91*a* has a driving portion 911*a* extending therefrom. By rotating the handle, the driving portion 911*a* of the inside driving member 91*a* drives the first biasing portion 45*a* formed at a side of the first latch driving member 4*a* to in turn press the rear biasing portion 46*a* of the first latch driving member 4*a* against the rear biasing portion 67*a* of the extension member 6*a* to further push the first latch 2*a* and the latch head 21*a* of the first latch 2*a* is then retracted back into the housing 1*a* (see FIG. 9) so as to place the latching device at an unlocked state. In addition, since the inside driving member 91*a* has a rectangular cross section and engages with the hole 52*a* of the second latch driving member 5*a*, the biasing portion 51*a* of the second latch driving member 5*a* is driven by the inside driving member 91*a* simultaneously to push the front biasing portion 32*a* of the second latch 3*a*, such that the latch head 31*a* of the second latch 3*a* is retracted back to the housing 1*a* for opening the door.

When a building is under construction, the orientation of a door is an important factor in influencing the comfort and the convenience inside the building. The inward or outward opening of the door, as well as the location of hinges will effect the arrangement of the latching device. The present invention can be modified to be adapted to a leftward opened door or a rightward opened door by detaching the face plate 13*a*, rotating the latch head 31*a* of the second latch 3*a* 180° and detaching the face plate 13*a*.

The above descriptions have clearly illustrated the important features, operational methods and applications of the present invention. Although the invention has been described with reference to the preferred embodiments, it will be obvious to persons skilled in the art that various changes and modifications may be made without departing from the scope of the invention as recited in the claims.

What is claimed is:

1. A latching device for a lock, comprising a housing, a first latch, an extension member, a first latch driving member, a second latch, a second latch driving member, a clutch device, an adjusting member and a pin, wherein:

said housing is formed with a hollow chamber;

said clutch device includes a positioning member and a positioning spring;

said first latch driving member is received within said housing and includes a front biasing portion, a rear biasing portion and a through hole;

said first latch has a front end which is provided with a latch head, and a rear end which is formed with at least one through hole and positioning hole for receiving said clutch device;

said extension member has a front biasing portion and a rear biasing portion, said rear biasing portion of said extension member being able to be driven rearward by said rear biasing portion of said first latch driving member for retracting said first latch back to its first position within said housing, and said front biasing portion of said extension member being able to be driven forward by said front biasing portion of said first latch driving member for extending said first latch out of said housing to its second position;

said second latch has a front end which is provided with a latch head, and a rear end which is provided with at least one biasing portion;

said second latch driving member has a hole for a driving member being inserted therethrough, and a biasing portion for biasing said second latch rearward to retract said second latch back to its second position within said housing;

said pin is received within said housing for operating said adjusting member and said clutch device, and for driving said extension member to selectively engage with said positioning member of said clutch device; and said adjusting member is able to drive said first latch driving member and said second latch driving member to their respective desired locations such that said first latch driving member and said second latch driving member are adapted to operate said first latch and said second latch, respectively.

2. The latching device for a lock according to claim 1, wherein said extension member further comprises a front positioning portion and a rear positioning portion, for being selectively engaged by said positioning member of said clutch device.

3. The latching device for a lock according to claim 1, wherein said first latch further has a slot formed adjacent to said through hole thereof and said extension member also has a sliding portion for slidably mating with said slot of said first latch.

4. The latching device for a lock according to claim 1, wherein said first latch driving member further has a first biasing portion which is adapted to be driven by a driving portion of a driving member of a lock.

5. The latching device for a lock according to claim 1, wherein said extension member further has a front projection and a rear projection which is adapted to be driven by said pin.

6. A latching device for a lock, comprising a housing, a first latch, a first latch driving member, a second latch, a second latch driving member an extension member, wherein:

said housing is formed with a hollow chamber;

said first latch has a front end which is provided with a latch head, and a rear end;

said extension member engaged with said rear end of said first latch;

said first latch driving member is received within said housing and being capable of selectively driving said first latch;

said second latch has a front end which is provided with a latch head, and a rear end which is provided with at least one first biasing portion and at least one rear biasing portion;

said second latch driving member has a hole for a driving member being inserted therethrough, and a biasing portion for biasing said second latch rearward to retract said second latch back to its second position within said housing.

* * * * *

UNITED STATES PATENT AND TRADEMARK OFFICE

CERTIFICATE OF CORRECTION

PATENT NO. : 6,928,844 B2 
DATED : August 16, 2005
INVENTOR(S) :Wei-Lung Chiang and Sheen-Youl Gao It is certified that error appears in the above-identified patent and that said Letters Patent is hereby corrected as shown below:

Title page,
Item [73], Assignee, should read -- Tong Lung Metal Industry Co., Ltd. --.

Signed and Sealed this

Seventh Day of February, 2006

JON W. DUDAS
*Director of the United States Patent and Trademark Office*